US006254292B1

(12) United States Patent
Navarro

(10) Patent No.: US 6,254,292 B1
(45) Date of Patent: Jul. 3, 2001

(54) PIN-SUPPORTED AND -ALIGNED LINEAR ENCODER STRIP FOR A SCANNING INCREMENTAL PRINTER

(75) Inventor: Emilio Angulo Navarro, Sant Cugat del Valles (ES)

(73) Assignee: Hewlett Packard Company, Palo Alto, CA (US)

( * ) Notice: Subject to any disclaimer, the term of this patent is extended or adjusted under 35 U.S.C. 154(b) by 0 days.

(21) Appl. No.: 09/253,566

(22) Filed: Feb. 19, 1999

(51) Int. Cl.[7] ..... B41J 29/42
(52) U.S. Cl. ..... 400/705
(58) Field of Search ..... 400/705

(56) References Cited

U.S. PATENT DOCUMENTS

| | | | | |
|---|---|---|---|---|
| 3,970,183 | | 7/1976 | Robinson et al. | 197/340 |
| 4,605,970 | * | 8/1986 | Hawkins | 358/265 |
| 5,992,969 | * | 11/1999 | Arminana Terrasa et al. | 347/37 |

FOREIGN PATENT DOCUMENTS

| | | | | |
|---|---|---|---|---|
| 0300823 | | 1/1989 | (EP) | G05B/19/417 |
| 0810546A2 | * | 12/1997 | (EP) . | |
| 63-077772 | | 4/1988 | (JP) | B41J/19/18 |

* cited by examiner

*Primary Examiner*—John S. Hilten
*Assistant Examiner*—Charles H. Nolan, Jr.

(74) *Attorney, Agent, or Firm*—Ashen & Lippman

(57) ABSTRACT

Spaced pins support and align the strip. Apertures in the strip engage the pins with no fastening. The strip—best a transparent member and glued strength member—is end-mounted and -tensioned. Ideally the apertures are slots to constrain the strip as to only one dimension, and spaced (ideally about 30 cm on centers) to facilitate cutting various-size strips (e. g. for spans of roughly 91½, 106½, 152½ and 183 cm) from common, preapertured stock. The strip is longer than a meter; the invention is progressively more valuable for 1¼ m or longer strips. At least one pin is placed to keep fundamental oscillation of the strip, due to environmental vibration, from moving the strip out of position. The invention can take the form of the strip only, for use with the pins; or a printer with encoding system having the strip and pins—and a sensor responsive to the encoder to control printing; or a method of preparing a system for use. The pins prevent the strip from leaving the sensor and permit use of very low tension—only that needed to hold up the strip, within its vertical-alignment tolerance, over a short span between pins. The tension, and thereby the vertical-dimension stack from encoder scale to sensor, are thus made virtually independent of encoder-strip length. Such a printer ideally has a printhead carriage that scans parallel to the strip; the sensor (adjacent to the strip and carried on the carriage) develops signals representing position and velocity of the sensor and carriage relative to the strip. Printheads on the carriage form color marks to construct an image on a print medium. A medium-advance mechanism provides relative motion between carriage and medium. A processor responds to the position/velocity signals, and coordinates the printheads and advance mechanism to form the image.

23 Claims, 11 Drawing Sheets

3
4
65
32
33
34
35
38
LPS
60
61
62
33m
33p
20
133
11
69
67
33m''
5
31
33m'
64
63

PIN-SUPPORTED AND -ALIGNED LINEAR ENCODER STRIP FOR A SCANNING INCREMENTAL PRINTER

RELATED PATENT DOCUMENTS

Related documents are coowned U.S. Pat. No. 5,276,970 of Wilcox, and U.S. Pat. No. 4,789,874 of Majette—and also U.S. patent application Ser. No. 08/657,722 in the names of Armiñana et al., issued as U.S. Pat. No. 5,992,969. Each of these documents in its entirety is incorporated by reference into this present document.

FIELD OF THE INVENTION

This invention relates generally to machines and procedures for printing text or graphics on printing media such as paper, transparency stock, or other glossy media; and more particularly to a scanning thermal-inkjet machine and method that construct text or images from individual ink spots created on a printing medium, in a two-dimensional pixel array. It is most particularly applicable to large-format printer/plotters.

BACKGROUND OF THE INVENTION (a) Encoders in incremental printing—Most large-format incremental printers use a linear encoder in determining and controlling printhead-carriage position and called "codestrip", tensioned along the scan-axis structure, and an encoder sensor that is assembled on the carriage—with a groove for the strip.

The sensor electrooptically reads markings on the taut strip. Associated electronics generates electronic pulses for interpretation by circuitry in the printer.

Some early tensioned encoder strips were all plastic, adequate for small, desktop printers but not for larger printer/plotter machines. Other early strips were glued to the carriage-supporting "beam" structure, but such a solution gave up the advantages of a separate tensioned strip—including much easier assembly and disassembly, on the assembly line as well as in the field.

Representative work of recent years in codestrip refinement appears in the Wilcox and Armiñana documents mentioned above. Such work in electronic interfacing appears in the Majette patent.

(b) Alignment—Accurate readings, and also minimization of noise in operation, require good alignment between the strip and sensor. Maintaining such performance reliably over the life of a product requires avoiding friction and wear—which in turn makes alignment even more important.

In the evolution of large-format printer/plotters, recent developments have tended toward use of these devices to print wider and wider mechanical drawings and posters. Of course these applications require wider-bed printing machines with correspondingly longer codestrips.

Alignment, however, is progressively more difficult for longer codestrips, partly because of the tendencies to sag under the influence of gravity and twist slightly due to very small variations in mounting angle at each end of the strip. A particularly problematic cause of misalignment is vibration in the working environment.

Vibration sources include impacts from nearby industrial construction, heavy motor traffic, elevators within the building and the like. Nevertheless, for codestrips of the type introduced in the Armiñana document, alignment has been under good control heretofore in systems having modest overall carriage travel—below about one meter (roughly three feet).

(c) The one-meter barrier—More recently it has been noted that performance for strips spanning about 107 cm (3½ feet) is acceptable, but only marginally so. A current generation of these machines requires encoder strips with spans of 152 cm and 183 cm (five and six feet respectively). In a machine of this size the associated long dimensions of the strip cause failures in functional-vibration tests, particularly in large-amplitude harmonic movement near the middle of the strip.

This vibration can produce bad readings from the sensor. For instance the counter may miss counting one or more scale graduations on the encoder strip. The result can be significant errors in a printed image.

In cases that are even more serious, vibration causes complete disassembly of the sensor system—as the strip jumps entirely out of the sensor groove. In such cases trained service personnel may be required to restore normal operation.

Damage to the strip can occur, and the sensor too may require repair. To prevent such problems the system is programmed to shut down the carriage servocontrol motor if the sensor system is able to detect that it has lost count of the encoder graduations—as for example if it loses the pulse train completely.

If such a loss of count occurs while the carriage is near either end of the mechanism, and moving rapidly toward that end, this safety override may not have enough time to stop the carriage before it reaches the end bulkhead. Considerable damage to the carriage and other parts of the mechanism can result.

For machines of modest size it is sufficient to provide a mechanical limiter that simply retains the strip within the sensor groove. The limiter and its installation represent undesirable added cost.

This simple solution, moreover, has proven inadequate for a strip over 1½ m long. Even though retained within the sensor, the strip undergoes oscillations large enough to make sensor measurements erratic and unreliable.

People familiar with this field will understand that the "barrier" suggested in the title of this subsection is not an abrupt step at precisely one meter. Rather the difficulty in achieving satisfactory codestrip arrangements increases progressively over a considerable range from, perhaps, less than one meter to two or possibly three meters. Nevertheless there is a clear qualitative difference, between lengths under one meter and lengths of, say, several meters.

(d) An overconstrained problem—The encoder strip is a rather simple mechanical article, but those skilled in the art will recognize that this seeming simplicity may be very deceptive. The strip interacts in subtle ways with several different complex components of the system.

As a result, it is not at all obvious how to overcome the difficulties outlined above. Some of the more-evident candidate solutions are impractical, due to certain persistent constraints.

The progressively larger machine formats, even below the one-meter barrier suggested earlier, have called for greater tension in the strip. Beyond that barrier, simple increase of tension in the strip is unacceptable.

One reason is that higher tension could potentially introduce safety concerns. Another reason is that higher tension in the strip can cause small twists and other irregular deformations in the associated mechanism. Even if microscopic, such interference with the straightness and structural integrity of the guide-and-support rods and beam can throw off the positional calibration of the whole carriage drive system.

Such potential damage can be difficult to detect, and the design cost of reevaluating the entire mechanical system for such potential damage is in itself severe. If found, such a problem can be compensated only by strengthening the entire structure. Beefing up the mechanism in that way, in turn, would entail additional weight and cost.

Another complication is that addition of stiffening elements or any other attachment to the strip itself would be extremely awkward, since the sensor groove is very narrow. Of course it is important not to add anything to the strip, or next to it, that might pose even greater risk of damage than the strip itself poses—that is to say, catastrophic failure modes must be evaluated as carefully as routine operation.

Thus a supporting ledge below the codestrip (reasonably remote from the moving sensor) might be useful, although costly, but it would not resolve the problem of the strip moving upward. A "ceiling" strip immediately above the codestrip, to correct that deficiency, does not appear practical since the encoder sensor—moving at high speed—could strike such a component.

It has been suggested to return to the approach of using adhesive to secure a strip to a solid beam structure. As mentioned earlier, however, that approach has associated inefficiencies and high costs. Such a beam-mounted encoder strip is also difficult to install and remove.

Using small screws or bolts to fix a thin metal strip along the base would be even more undesirable. The assembly time required to thread in several screws is a significant cost in terms of modern production engineering. A separate rigid structure—to be bolted into place on the beam—would be still more impractical.

Still another difficulty of earlier codestrip designs relates to the dimension stack. The dimension stack is the group of geometrical dimensions that must be algebraically added to calculate the relative position between two specified parts.

Every dimension has a tolerance. If the number of dimensions is large—i. e. if the dimension stack is "long"—the tolerance can become very large, which is very undesirable.

The pertinent parts in this case are the encoder strip and sensor, and the most problematic dimension is vertical alignment between the graduations and the sensor. For use of standardized parts and good performance, clearance between the top of the strip and the top of the sensor groove is only about two millimeters; and the graduations are roughly just four millimeters tall.

Accordingly in one common failure mode the codestrip strikes the upper end of the groove. In another, as mentioned earlier, the downward-moving codestrip entirely leaves the groove.

Making the groove substantially taller would result in greater noise levels in the electronics system. It would also implicate still further problems of mechanical alignment between parts.

The encoder dimension stack for large-format printer/plotters is in fact undesirably lengthy. It is long primarily because of the tensioned mounting system—and also because the codestrip itself in these wide-bed systems is literally long, leading to large variations in vertical position at each point along the strip.

In particular, the stack for the vertical relationship between the encoder-scale graduations and the immediately adjacent sensor includes the mounting tolerances within the sensor, and tolerances of the sensor mounting to its carriage. Next the stack continues through the carriage, and the carriage bushings, to the rods—then the beam, then the codestrip, and finally tolerances within the strip to the scale graduations.

As a result, variation between machines, as to the vertical sensor-to-scale alignment, is very large. Mounting and configuration of the strip itself, however, accounts for much of this variation.

Finally, an ideal solution should be one that is amenable to routine incorporation into not only 1½ to 2 m printers but also into both smaller and larger systems. For instance, a solution should be usable in 107-cm units previously described as "marginal" in encoder-strip performance, and also in 3 m or 7 m systems.

It would be an added bonus to find a solution that could be implemented in a retrofit mode for any smaller systems installed in especially problematic (high vibration) environments. As this discussion shows, the codestrip problem is a particularly knotty one that defies easy solutions.

(e) Conclusion—Codestrip instabilities have impeded the extension of uniformly excellent incremental printing to images well over a meter wide. Thus important aspects of the technology used in the field of the invention remain amenable to useful refinement.

SUMMARY OF THE DISCLOSURE

The present invention introduces such refinement. In its preferred embodiments, the present invention has several aspects or facets that can be used independently, although they are preferably employed together to optimize their benefits.

In preferred embodiments of a first of its facets or aspects, the invention is an encoder strip for use in incremental printing. More specifically the strip is for use with mounting means that include a series of spaced pins for nonfastening support and alignment of the strip.

The encoder strip includes an elongated member defining incremental-printer encoder indicia. It also includes a series of spaced apertures formed in the elongated member for nonclamping engagement with the spaced pins.

The foregoing may constitute a description or definition of the first facet of the invention in its broadest or most general form. Even in this general form, however, it can be seen that this aspect of the invention significantly mitigates the difficulties left unresolved in the art.

In particular, because it can be both supported and restrained vertically by the pin-and-aperture combinations, the novel codestrip can be mounted with much lower tension than earlier strips. The vertical support and restraint can be used to prevent the strip from bouncing downward out of the encoder groove—or upward and striking the end of the groove—particularly near the middle of the span, as well as from sagging and rotating.

Nevertheless, since it is not to be fastened to its supports at the several pins, this codestrip is quickly and easily installed and replaced. It is also subject to substantially common tension all along its length and so behaves in a consistent fashion longitudinally.

Although this aspect of the invention in its broad form thus represents a significant advance in the art, it is preferably practiced in conjunction with certain other features or characteristics that further enhance enjoyment of overall benefits.

For example, it is preferred that the ends of the elongated member are for fastening to the mounting means, to secure and tension the elongated member. In this arrangement, at least one of the spaced apertures is spaced distinctly away from the fastening ends of the elongated member.

Preferably the codestrip is a composite strip comprising a transparent member secured to a strength member. Also preferably the spaced apertures are shaped to constrain the elongated member with respect to exclusively one dimension; preferably they are slot-shaped (this allows for thermal expansion and contraction independently of the pins and mount).

Preferably the elongated member exceeds approximately one meter (roughly forty inches) in length. Still more preferably the elongated member exceeds approximately 1.25 meter (approximately fifty inches) in length.

The member is capable of use in spans of 1.5 and 1.75 meters (sixty and seventy) inches and longer, in which its use is still more preferable. The present novel codestrip escapes from the previously undesirable relationship between tension or positioning problems, on the one hand, and length on the other hand.

Preferably the apertures are spaced to facilitate cutting elongated members in several different sizes from common, preapertured stock. More specifically, it is preferred that they be spaced at approximately thirty centimeters (11¾ inches) on centers to facilitate cutting spans of approximately 91½, 106½, 152½ and 183 centimeters (thirty-six, forty-two, sixty and seventy-two inches) from common, preapertured stock.

Preferably at least one of the spaced apertures is positioned to prevent fundamental oscillation of the elongated member, due to environmental vibration, from moving the elongated member out of a specified operating position. Such positioning is especially effective in avoiding the vertical bouncing or sagging of previous codestrips, particularly in case of vibration from nearby equipment as mentioned earlier.

In preferred embodiments of a second of its major aspects, the invention is a printer for use in incremental printing. The printer has an encoding system, and includes an elongated encoder strip defining encoder indicia—and having spaced apertures formed in the encoder strip.

In preferred embodiments of a second of its major aspects, the invention is a printer for use in incremental printing. The printer has an encoding system, and includes an elongated encoder strip defining encoder indicia—and having spaced apertures formed in the encoder strip.

The printer also includes some means for mounting the encoder strip. For purposes of generality and breadth in discussing the invention, these means will be called simply the "mounting means".

The mounting means in turn include some means for nonclamping protrusion through the spaced apertures of the encoder strip to support and align the encoder strip. Again for breadth and generality these means will be called the "nonclamping protrusion means".

The nonclamping protrusion means include a series of spaced pins. Also part of the printer are some means for responding to the encoder indicia (the "responding means") to control printing.

The foregoing may constitute a description or definition of the second facet of the invention in its broadest or most general form. Even in this general form, however, it can be seen that this aspect of the invention too significantly mitigates the difficulties left unresolved in the art.

In particular, the incremental printer of this second aspect of the invention is capable of forming drawings or photographic-quality pictures on paper of virtually unlimited width, since the printer itself can now be manufactured essentially as wide as desired.

Although this second aspect of the invention in its broad form thus represents a significant advance in the the "supporting and tensioning means" or in shorthand form the "end-supporting means". In this case, at least one of the spaced pins is spaced distinctly away from the end-supporting means.

Another preference, particularly if the printer includes a scanning printhead carriage that moves substantially parallel to the encoder strip, is that the printer further have a sensor disposed adjacent to the encoder strip and carried on the scanning printhead carriage. Here it is preferable that the previously mentioned responding means include means for developing signals representative of position and velocity of the sensor and carriage relative to the encoder strip. These signal-developing means are responsive to the sensor.

Yet another preference is that the printer include printheads carried on the carriage and forming colorant patterns on the printing medium—to construct an image on the medium—and a printing-medium advance mechanism providing relative motion, perpendicular to the scanning printhead carriage, between the carriage and the printing medium. In this case the responding means further include a digital processor to coordinate the printheads and the advance mechanism in forming the image. The processor is responsive to the position- and velocity-representative signals.

In this novel printer, not only the required tension but also the scale-to-sensor dimension stack is essentially independent of codestrip length. The tension need only be high enough to hold the vertical positioning of the strip within a rather tight specification over the relatively short distance between two adjacent pins—a very easy task.

With this condition specified, that severe specification is the only number in the stack that importantly relates to sagging of the strip. That specification is substantially unrelated to the overall strip length.

In preferred embodiments of a third of its basic aspects or facets, the invention is a method for preparing and using an encoder strip, for use in incremental printing. The strip itself includes a thin, narrow, elongated member.

The method includes the steps of mounting the strip in tension with respect to its elongated dimension; and constraining the strip at multiple points spaced apart along its elongated dimension, for alignment with respect to its narrow dimension. The method also includes the step of leaving the strip substantially unconstrained with respect to its thin dimension; this last step, however, is not applied with respect to the ends of the strip, where in fact the strip is constrained with respect to its thin dimension.

Again this aspect of the invention, even as couched in these broad terms, significantly advances the art of incremental printing. This is so because, by the steps stated, the method establishes an encoding function that is essentially immune to displacement of the codestrip entirely out of operating position in its encoder, and also to lesser displacements sufficient to throw off the automatic counting of encoder indicia. Yet this method maintains uniform tension along the codestrip span, allows for natural thermal response, and leaves the strip sufficiently independent of its mounts for very easy installation, disassembly and reassembly.

Nevertheless it is preferable to use this novel method in conjunction with certain further features or characteristics that additionally enhance enjoyment of the benefits of the invention. For example, preferably the constraining step includes providing spaced-apart restraints for the strip, along the elongated dimension; and the mounting step comprises disposing the strip to engage the spaced-apart restraints.

Another preference is that the constraining step include providing apertures in the strip, spaced apart along the elongated dimension; and providing pins to protrude through the apertures without fastening the strip to the pins. In this case certain further preferences apply, particularly if the method is for use with an encoder sensor that undergoes relative motion with respect to the strip, along the elongated dimension.

Among those preferences are these three: the mounting step comprises disposing the strip in a functional positioning with respect to the sensor; in operation the strip is subject to vibration that tends to disturb that functional positioning; and the pins maintain the functional positioning. In this case, particularly if the system includes an encoder sensor that has a channel for the strip, it is yet further preferable that the mounting step include disposing the strip to extend through the channel in the sensor; and that the pins prevent the strip from leaving the channel.

All of the foregoing operational principles and advantages of the present invention will be more fully appreciated upon consideration of the following detailed description, with reference to the appended drawings, of which:

DETAILED DESCRIPTION OF THE PREFERRED EMBODIMENTS

Figures 1, 2, 3:
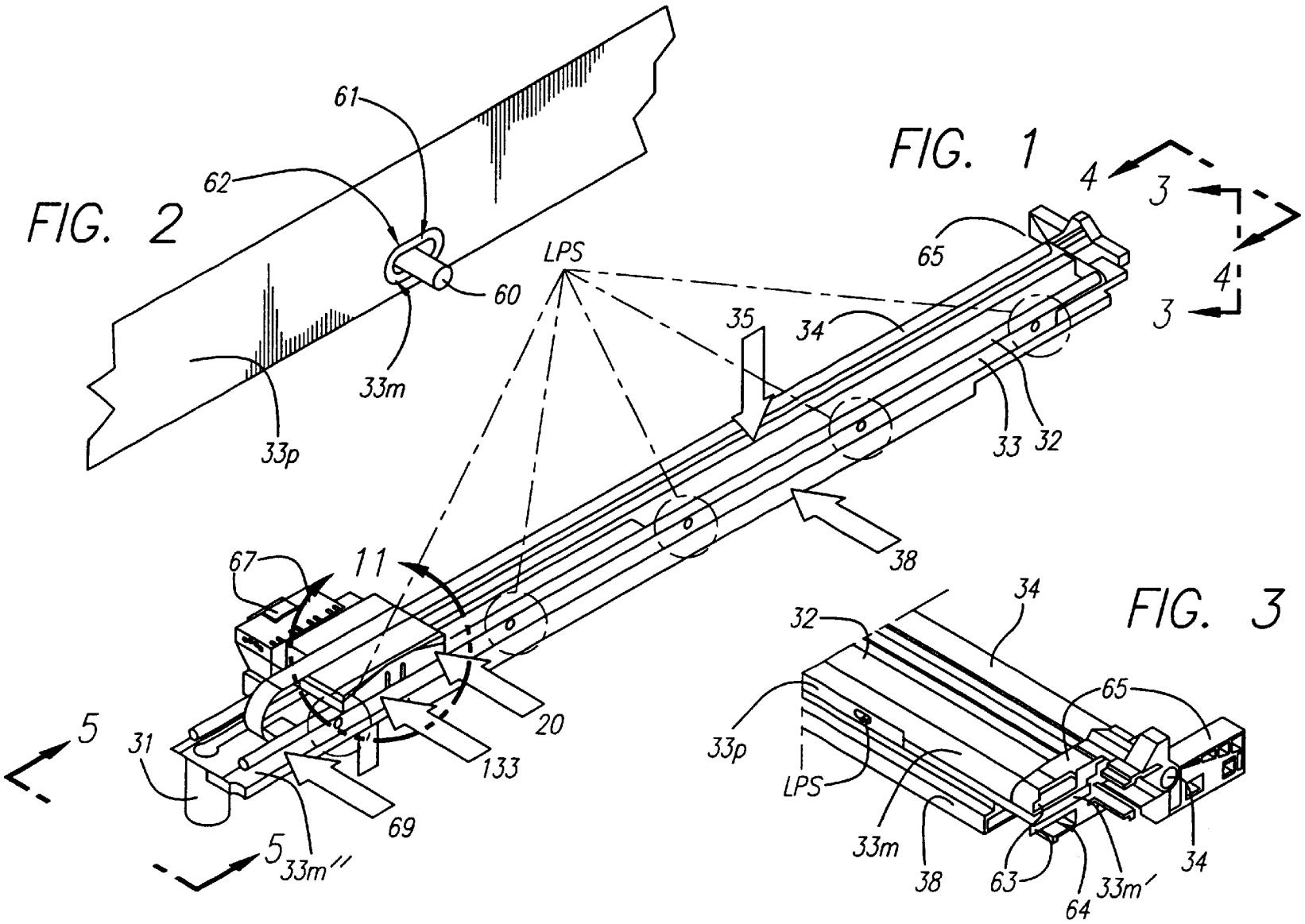
FIG. 1 is an isometric or perspective view, taken from right rear and above, of a carriage and carriage-drive mechanism according to a preferred embodiment of apparatus aspects of the present invention.
FIG. 2 is a like view, but very greatly enlarged, of locating pins and slots at the exemplary five positions marked "LPS" in FIG. 1.
FIG. 3 is a view like FIG. 1 but enlarged and taken along the lines 3—3 (i. e. from left rear and above) in FIG. 1.

1. Encoder Strip with Support and Alignment a. Pin support and guidance—Preferred embodiments of the invention provide a novel way to hold and reference the encoder strip 33 (FIG. 1). The new system is remarkably very simple and elegant.

As taught in the Armiñana document mentioned earlier, the strip 33 is made up of a metal strength member 33*m* (FIG. 3) and a plastic scale 33*p*. Also as explained by Armiñana the plastic piece 33*p* has the function of guarding the fine metal edges of the metal member 33*m*.

Mounted along the scan-axis beam 38, spaced longitudinally are locating pins 60 (FIG. 2). Correspondingly spaced slots 61, 62 are punch-formed along the two-piece encoder strip 33.

When all assembled to the beam 38, the pins 60 and slots 61, 62 form spaced-apart sets of locating pins and slots LPS. The strip 33 at assembly is tensioned from its ends as before but also positioned on the pins 60—i. e. so that the pins 60 extend through the slots 61, 62 in the strip 33.

Figure 5:
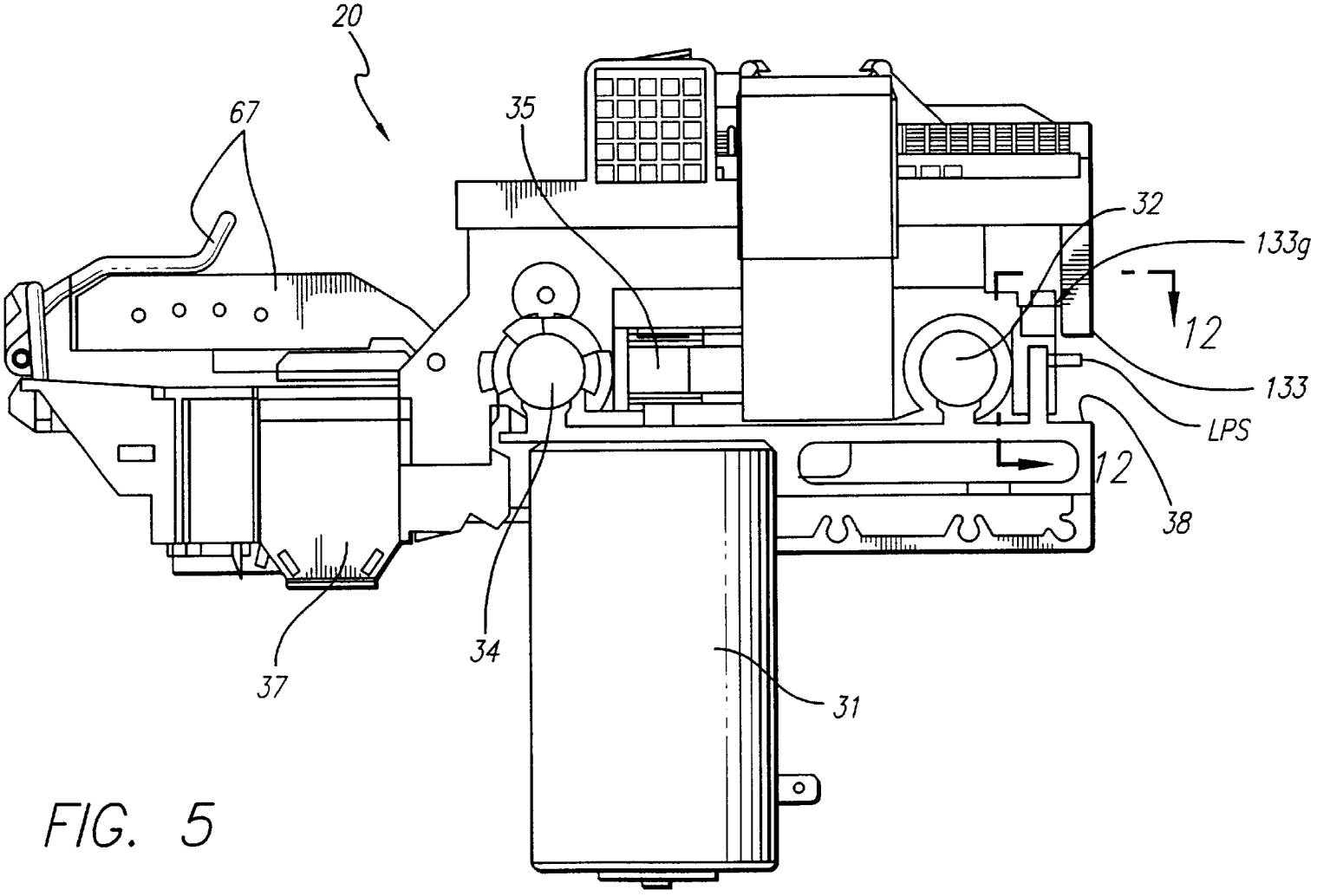
FIG. 5 is a right end elevation, taken along the lines 5—5 in FIG. 1.
Figure 12:
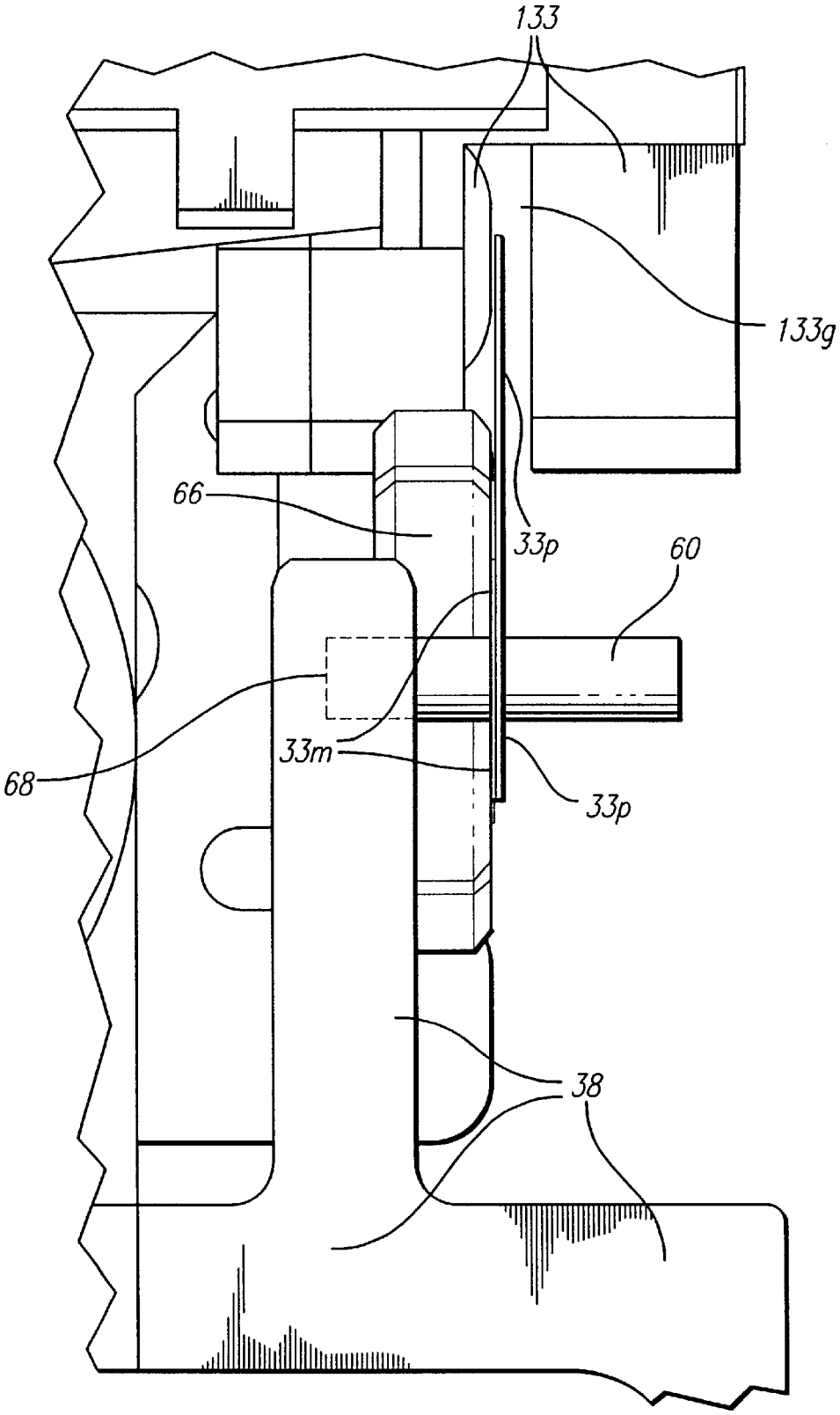
FIG. 12 is a view like FIG. 4 but enlarged and showing the region within the sight marked 12—12 in FIG. 4.

The plastic scale 33*p* has alternating transparent and opaque portions forming graduations, as fully detailed Armiñana. This scale passes through a groove 133*g* (FIGS. 5 and 12) in the sensor 133. The sensor 133 has a light source at one side of the groove and a detector at the other.

The pins 60 prevent the previously troublesome vertical movement. They locate the strip 33 in a very accurate position for the sensor 133 to read the graduations.

More specifically, mounting holes 68 for the locating pins 60 are formed along the beam 38. The pins 60 are inserted into the mounting holes 68 and extend from the beam 38 toward the position of the encoder strip 33, 33*m*, 33*p*. A plastic spacer 66 stands off the strip 33 from the beam 38, to the correct location within the sensor groove 133*g*.

As formed in the metal portion 33*m* of the strip 33, the slots 61 (FIG. 2) are in a close clearance fit with the pins 60. Ordinarily the exact clearance is not extremely critical since the strip 33 is under some tension and therefore tends to pull the slot edges of the thin metal strength member 33*m* into position as required even in case of some very slight degree of interference fit.

As formed in the plastic scale 33*p*, the slots 62 are larger than those in the strength member 33*m*. The point is to ensure that the locating action, and any necessary straightening forces, bear upon the strength member 33*m*, rather than the relatively compliant plastic scale 33*p*.

A small area of the metal member 33*m* thus is seen in the illustration, through the slot 62 serving as a window in the plastic scale 33*p*. Slots 61, 62 rather than circular holes are formed in the codestrip 33 to accommodate very slightly different thermal deformation behaviors of the strip 33 and beam 38.

Preferably at least one set LPS of locating pins and mating slots is relatively near the center of the strip, longitudinally, so as to deter vibration in a fundamental mode. The concern is vibrational amplitude, not particular harmonics; therefore it has proven unnecessary to space the pins-and-slot sets LPS according to any special harmonic analysis.

This freedom is advantageously exploited to enable manufacture of the codestrips for different machine sizes from common stock. The pin mounting holes 68 and the slots 61, 62 are accordingly spaced for manufacturing convenience at a uniform distance of approximately 30 cm on centers (11¾ inches). That spacing has been found to provide suitable clear lengths at the ends of the strip for mounting, in every machine size now contemplated.

Preferably one end 33*m*" of the strength member 33*m* is bolted 69 to a solid mount, and the other end 33*m*' (FIGS. 3 and 4) clamped or bolted to a spring plate 63—on the end bulkhead 65—that provides a calibrated tension. A retaining pin 64 projects from the spring plate 63, and positively locates that end 33*m*' of the strength member longitudinally.

b. Tension—In current products, tension levels are similar to those in previous units. Much of the earlier design of the spring 63 is being reused; the tensioning holder is very rigid and can effectively resist the tension.

For future models with larger scan-axis dimensions it will not be necessary to increase the tension at all, because cause the encoder weight is supported by the pins. In smaller products—unless they are modified to incorporate the present invention—the strip weight must be compensated with tension, exerting relatively high force on the tensioned holder.

Thus for example in earlier designs the encoder-strip tension for a machine with printing area 91 cm (3 foot) wide the tension is 36 newtons—but for a machine with 137 cm (4½ foot) printing area, 5 newtons. With the current invention, the tension for the 91 cm machine can still be 36 N, and a 152 cm (5 foot) machine, too, is only 36 N.

Such low tension causes no problems. Nevertheless if desired the tension in both machine sizes could be reduced from 36 to, say, 25 N.

Perhaps most important in this regard, required tension is now independent of codestrip length. The tension need only be sufficient to maintain good vertical-positioning tolerance over the span between any two adjacent pins—i. e., only about 30 cm.

c. Straightness—The straightness of the current encoder is just the straightness of the pin locations on the rod beam. In the current best implementation it is less than ±0.15 mm. With no pins the natural deformation of the encoder is much greater, on the order of ±0.8 mm, and can vary with time, from lot to lot, etc.

d. Dimensional stack—As noted earlier, codestrip designs heretofore have suffered from an unduly long dimension stack. The present invention permits a major reduction in the stack, and makes the stack—like the tension—in essence independent of codestrip length.

Height variation in the encoder-strip scale is now only the tolerance for a short span of 30 cm between pins. That is determined by the codestrip properties and the tension—which as already noted has also been made independent of the strip length.

In consequence, tolerances of every related dimension can be smaller. A much more robust design has resulted.

e. Slot-and-threaded-support variant—In practice of the present invention, pressed-in pins are greatly preferred to screw-in elements such as studs and screws. With proper installation equipment, pins are much faster to install in the base.

Screw-in-elements, however, are entirely usable in place of pins, and may be substituted if desired for whatever reason. One possible situation in which screws or studs may be helpful is field retrofit of older machines.

As noted earlier, such products may be advantageously retrofitted with slot support according to the present invention. Retrofit is useful if operation is affected by nearby construction, passing trucks, railway or subway lines, heavy industry or buildings with active freight elevators and the like.

Trained field-service personnel using suitable special jigs or fixtures can drill and tap precisely positioned holes in the base. Studs or screws are then readily installed to support the codestrip.

f. Representative dimensions—The accompanying specifications are typical of a now-preferred embodiment. Except to the extent incorporated into the accompanying claims, they should be considered merely exemplary.

Figure 4:
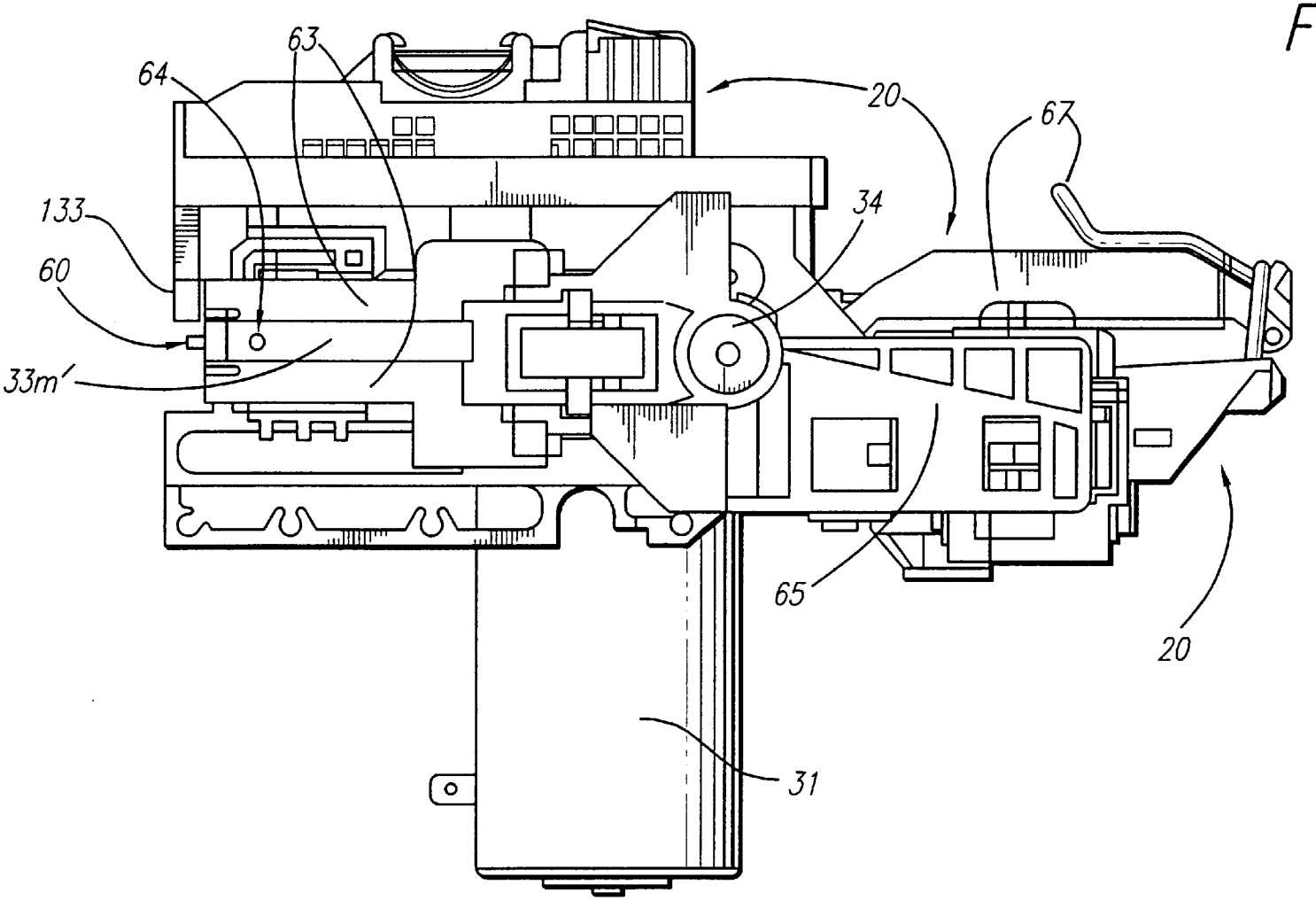
FIG. 4 is a left end elevation, taken along the lines 4—4 in FIG. 1.

| | dimensions (mm) | | | |
|---|---|---|---|---|
| | | | slot | |
| strip | overall strip | | length on | |
| portion | height | thickness | centers | diameter |
| metal | 8 | 0.1 | 3 | 2.1 |
| plastic | 14 | 0.18 | 3 | 3.75 |
| | | 4A length | | |
| | spacing | embed | project | tot. | diameter |
| pins | 300 | 3 | 9 | 12 | 2 |
| | overall approx. width in FIGS. 4 & 5 | | | |
| carriage | 250 | | | |

g. Relationship to the prior art—The present invention enables strips with spans of 152 cm and 183 cm (five and six feet respectively) to be assembled into a large-format printer/plotter in a completely routine way. Yet it substantially eliminates previously pervasive failures in functional-vibration tests—near the middle of the strip as well as elsewhere.

Vibration-induced bad readings from the sensor, such as miscounting by one or more scale graduations, have become essentially historical phenomena. The strip never jumps out of the sensor groove and accordingly never threatens to drive into the end bulkheads or in any other way to damage nearby components.

No support ledge, "ceiling" element, or limiter is used. Tension in the strip is essentially as low as could be desired, substantially obviating safety concerns in this regard—as well as all potential for related deformations and calibration problems. It has not been necessary to strengthen the beam or any other part of the mechanism to achieve these goals.

No stiffening element or other attachment to the strip itself is used, and nothing is added to the strip or immediately next to it that might pose a risk of damage. No adhesive, screw or bolt is needed to fix the strip to the base; rather the pins are simply pressed into place, significantly restraining assembly cost.

Required tension is dramatically reduced. Perhaps more importantly, the tension is now substantially independent of the codestrip length.

The tension need only be sufficient to provide good straightness over the roughly 30 cm span between adjacent pins. The encoder dimension stack, too, is correspondingly reduced, and also essentially independent of the encoder-strip length.

Therefore the invention can be routinely incorporated into the present generation of 1½ to 2 m printers—and also into smaller systems, and even much larger systems, with equal ease. It can be implemented in a retrofit mode for smaller systems in problematic environments.

In other words, the present system not only resolves the problems described in the "BACKGROUND" section of this document for strips one to two meters long, but actually appears to remove the length barrier entirely. With the present invention, strips under modest tension can be supported with reliable orientation and positional stability at practically any length desired. The pin-located codestrip has resolved every aspect of the defiant, knotty problems detailed earlier.

2. Other Hardware Components

As noted earlier, the present invention is compatible equally well with the present generation of 1½ m and 2 m printer/plotters and earlier basic designs, some of which remain in production. This is emphasized by showing a different model, to illustrate general features of the preferred printer/plotter, from the unit appearing in FIGS. 1 through 5, and FIGS. 11 and 12.

Figure 6:
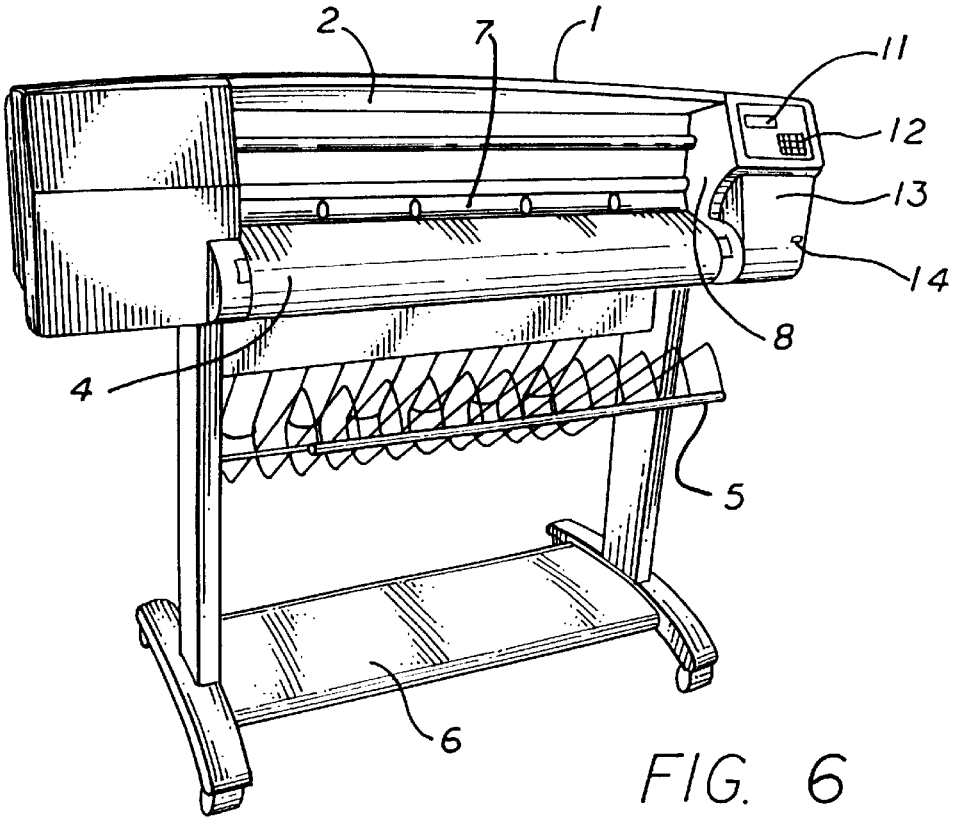
FIG. 6 is an isometric or perspective exterior view of a large-format printer-plotter which is a preferred embodiment of the present invention, and which includes mechanisms closely similar to those of FIGS. 1 through 5.

Thus some preferred embodiments include a main case 1 (FIG. 6) with a window 2, and a left-hand pod 3 that encloses one end of the chassis. Within that pod are carriage-support and -drive mechanics and one end of the printing-medium advance mechanism, as well as a pen-refill station containing supplemental ink cartridges.

The printer/plotter also includes a printing-medium roll cover 4, and a receiving bin 5 for lengths or sheets of printing medium on which images have been formed, and which have been ejected from the machine. A bottom brace and storage shelf 6 spans the legs which support the two ends of the case 1.

Just above the print-medium cover 4 is an entry slot 7 for receipt of continuous lengths of printing medium 4. Also included are a lever 8 for control of the gripping of the print medium by the machine.

A front-panel display 11 and controls 12 are mounted in the skin of the right-hand pod 13. That pod encloses the right end of the carriage mechanics and of the medium advance mechanism, and also a printhead cleaning station. Near the bottom of the right-hand pod for readiest access is a standby switch 14.

Figure 7:
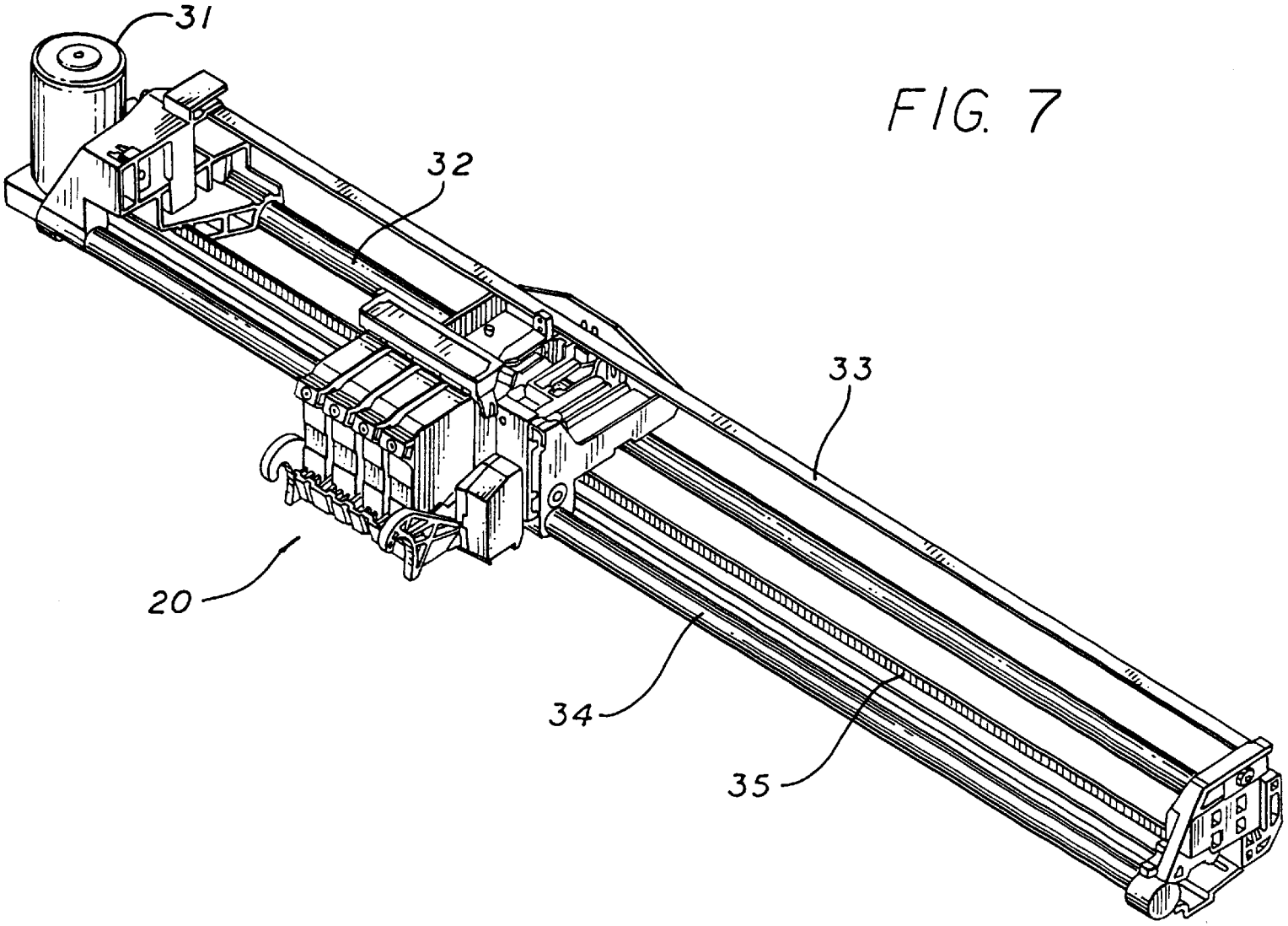
FIG. 7 is a view like FIG. 1 but of the FIG. 6 machine and taken from front above left.
Figure 13:
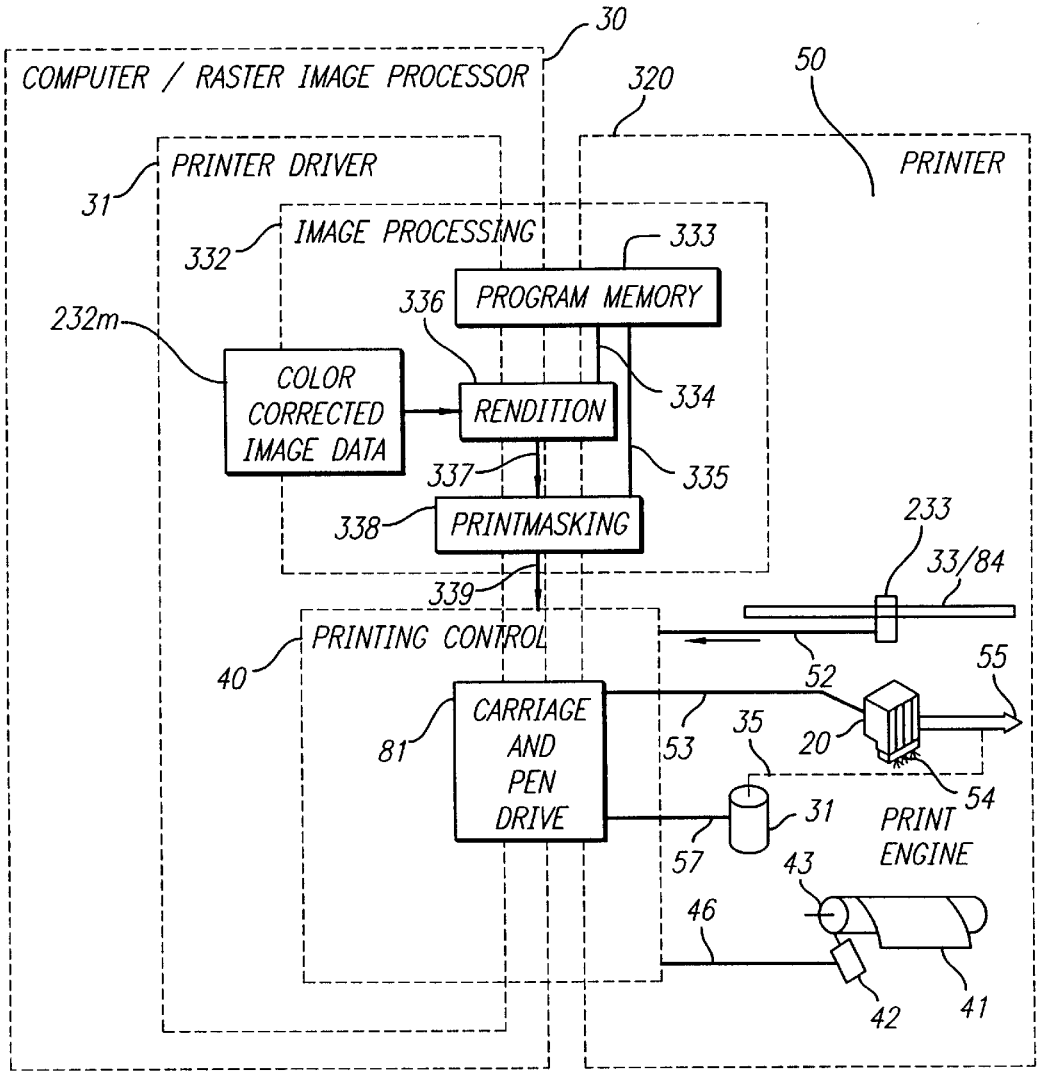
FIG. 13 is a conceptual block diagram of the printers of FIGS. through 12.

Within the case 1 and pods 3, 13 the carriage assembly 20 (FIG. 7) is driven in reciprocation by a motor 31—along dual support and guide rails 32, 34—through the intermediary of a drive belt 35. The motor 31 is under the control of signals 57 from a digital electronic microprocessor (essentially all of FIG. 13 except the print engine 50). In the block-diagrammatic showing, the carriage assembly 20 travels to the right 55 and left (not shown) while discharging ink 54.

A very finely graduated encoder strip 33 is extended taut along the scanning path of the carriage assembly 20, and read by an automatic optoelectronic sensor 133, 233 to provide position and speed information 52 for the microprocessor. (In FIG. 13, signals in the print engine are flowing from left to right except the information 52 fed back from the encoder sensor 233—as indicated by the associated leftward arrow.)

The codestrip 33 thus enables formation of color inkdrops at ultrahigh resolution (typically 24 pixels/mm) and precision, during scanning of the carriage assembly 20 in each direction.

A currently preferred location for the encoder strip 33 is near the rear of carrisge tray (remote from the space into which a user's hands are inserted for servicing of the pen refill cartridges). Immediately behind the pens is another advantageous position for the strip 36 (FIG. 3).

Figure 8:
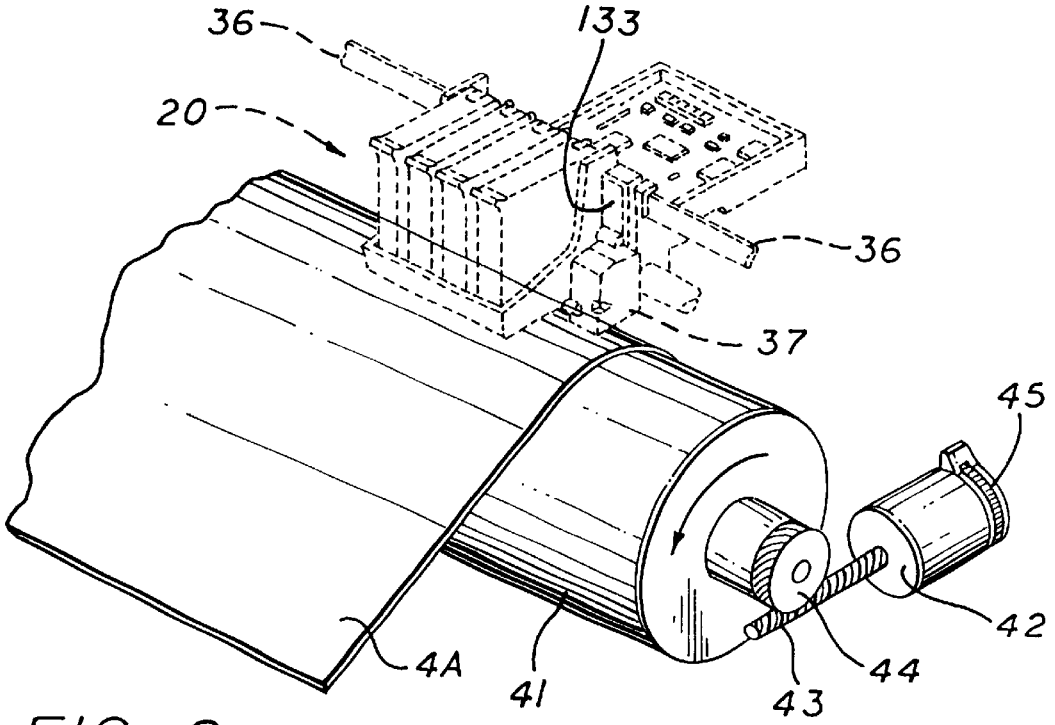
FIG. 8 is a like view of a printing-medium advance mechanism which is mounted within the case or cover of the FIG. 6 device, in association with the carriage as indicated in the broken line in FIG. 8.

The encoder sensor 133 (for use with the encoder strip in its forward position 33) or 233 (for rearward position 36) is disposed with its optical beam passing through orifices or transport portions of a scale formed in the strip. A separate line sensor 37 (FIGS. 5, 7 and 8) also rides on the carriage 20, for reading test patterns or other information from the printing medium.

A cylinder platen 41 (FIG. 8)—driven by a motor 42, worm 43 and worm gear 44 under control of signals 46 from the processor 15—rotates under the carriage-assembly 20 scan track to drive sheets or lengths of printing medium 4A in a medium-advance direction perpendicular to the scanning. Print medium 4A is thereby drawn out of the print-medium roll cover 4, passed under the pens on the carriage 20 to receive inkdrops 54 for formation of a desired image, and ejected into the print-medium bin 5.

Figure 9:
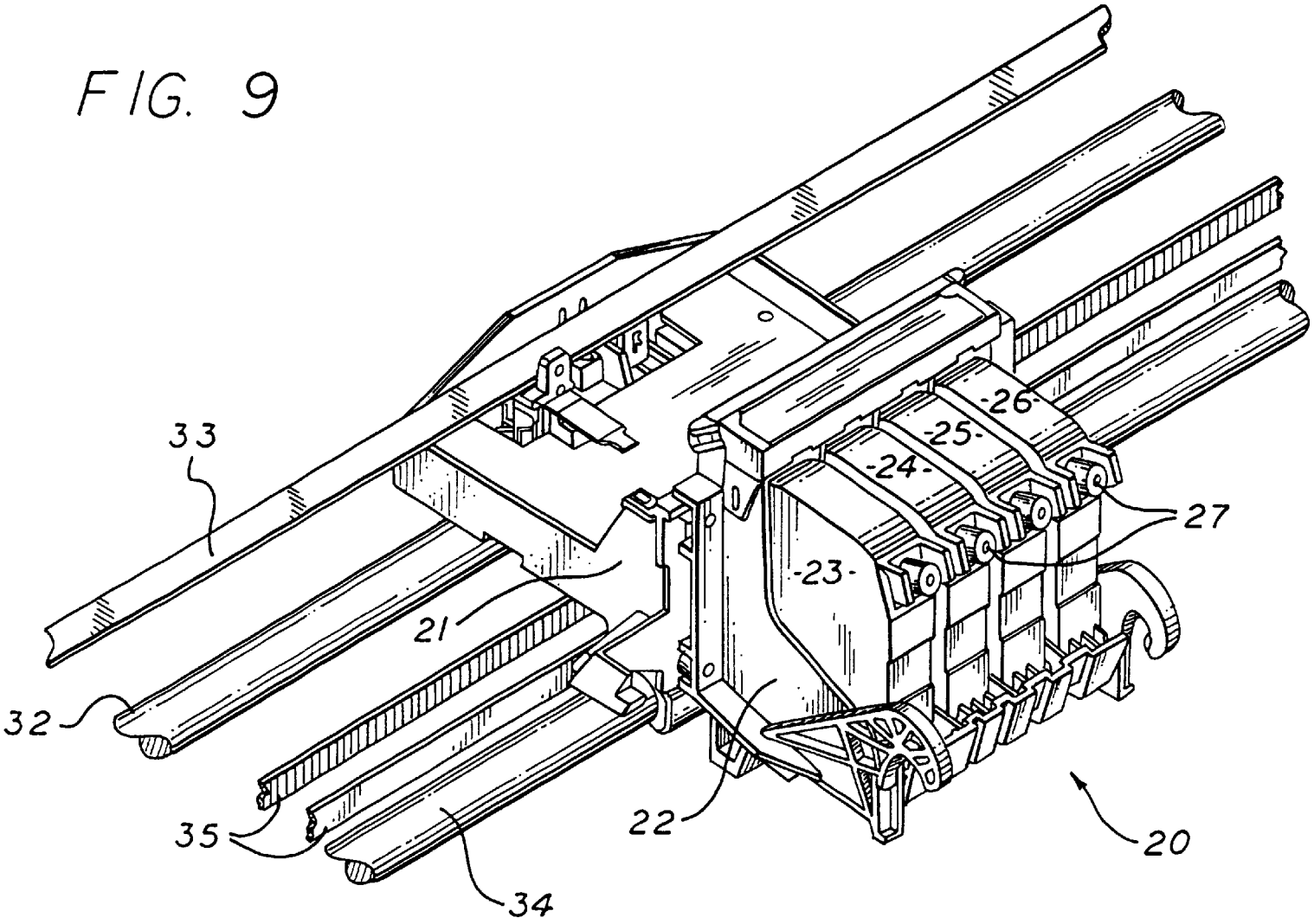
FIG. 9 is a like but more-detailed view of the FIG. 7 carriage, showing the printheads or pens which it carries.

The carriage assembly 20 includes a previously mentioned rear tray 21 (FIG. 9) carrying various electronics. It also includes bays 22 for preferably four pens 23–26 holding ink of four different colors respectively—preferably cyan in the leftmost pen 23, then magenta 24, yellow 25 and black 26.

In the illustrations of the current model (FIGS. 1 through 5), the pens are not shown installed. When in place they are under the cartridge retainer latch 67 and project downward slightly beyond the bottom of the line sensor 37.

Figure 10:
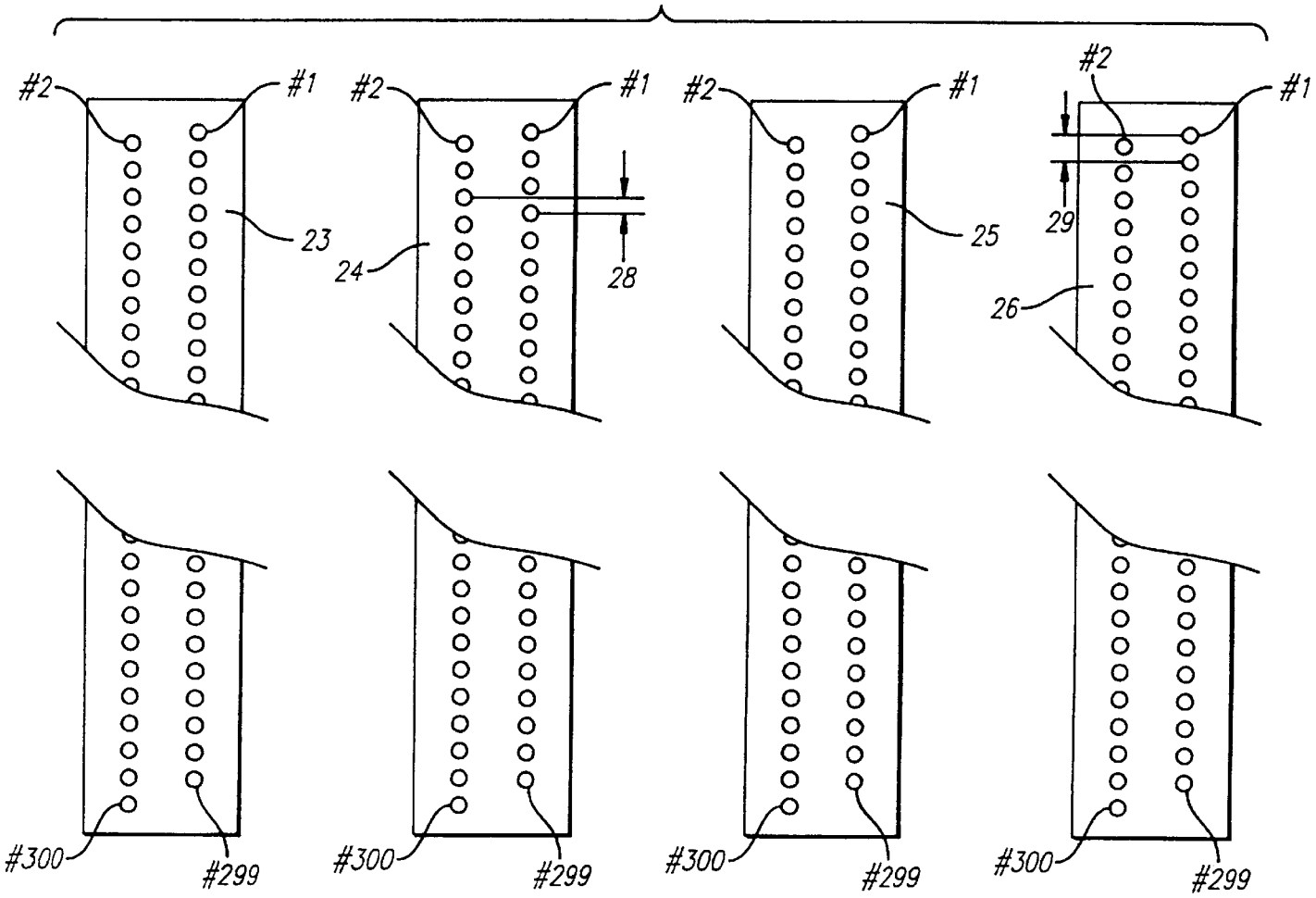
FIG. 10 is a bottom plan of the printheads or pens, showing their nozzle arrays.
Figure 11:
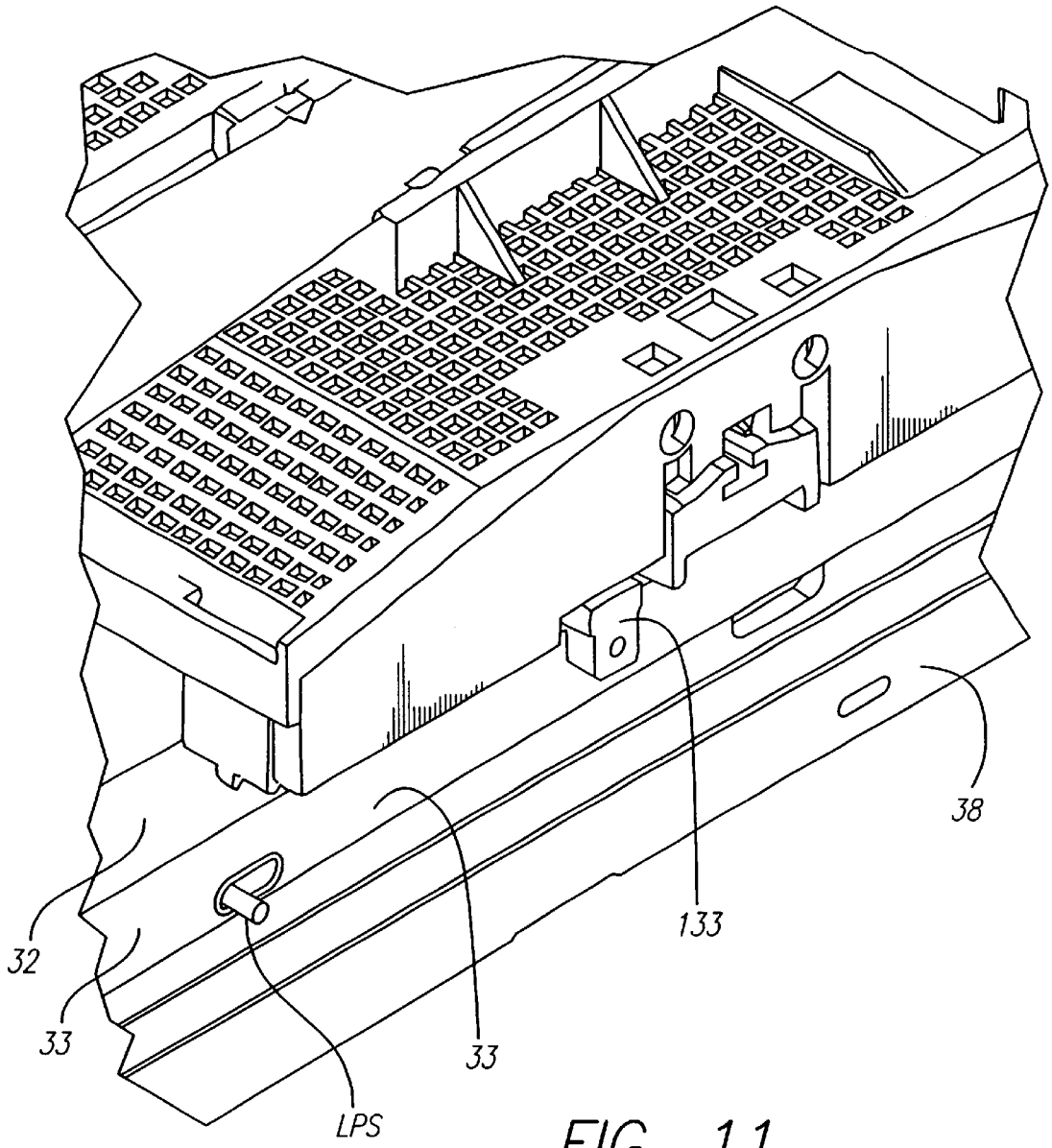
FIG. 11 is a detail view like FIG. 1 but enlarged and showing the region in the sight marked 11—11 in FIG. 1.

Each of the pens, particularly in a large-format printer/plotter as shown, preferably includes a respective ink-refill valve 27. The pens, unlike those in earlier mixed-resolution printer systems, all are relatively long and all have nozzle spacing 29 (FIG. 10) equal to one-twelfth millimeter—along each of two parallel columns of nozzles. These two columns contain respectively the odd-numbered nozzles 1 to 299, and even-numbered nozzles 2 to 300.

The two columns, thus having a total of one hundred fifty nozzles each, are offset vertically by half the nozzle spacing, so that the effective pitch of each two-column nozzle array is approximately one-twenty-fourth millimeter. The natural resolution of the nozzle array in each pen is thereby made approximately twenty-four nozzles (yielding twenty-four pixels) per millimeter, or 600 per inch.

Preferably black (or other monochrome) and color are treated identically as to speed and most other parameters. In the preferred embodiment the number of printhead nozzles used is always two hundred forty, out of the three hundred nozzles (FIG. 10) in the pens.

This arrangement allows for software/firmware adjustment of the effective firing height of the pen over a range of ±30 nozzles, at approximately 24 nozzles/mm, or ±30/24= ±1¼ mm. This adjustment is achieved without any mechanical motion of the pen along the print-medium advance direction.

Alignment of the pens can be automatically checked and corrected through use of the extra nozzles. As will be understood, the invention is amenable to use with a very great variety in the number of nozzles actually operated.

3. Microprocessor Hardware

Data-processing arrangements for the present invention can take any of a great variety of forms. To begin with, image-processing and printing-control tasks 332, 40 can be shared (FIG. 13) among one or more processors in each of the printer 320 and an associated computer and/or raster image processor 30.

A raster image processor ("RIP") is nowadays often used to supplement or supplant the role of a computer or printer—or both—in the specialized and extremely processing-intensive work of preparing image data files for use, thereby releasing the printer and computer for other duties. Processors in a computer or RIP typically operate a program known as a "printer driver".

These several processors may or may not include general-purpose multitasking digital electronic microprocessors (usually found in the computer 30) which run software, or general-purpose dedicated processors (usually found in the printer 320) which run firmware, or application-specific integrated circuits (ASICs, also usually in the printer). As is well-understood nowadays, the specific distribution of the tasks of the present invention among all such devices, and still others not mentioned and perhaps not yet known, is primarily a matter of convenience and econoics.

On the other hand, sharing is not required. If preferred the system may be designed and constructed for performance of all data processing in one or another of the FIG. 13 modules—in particular, for example, the printer 320.

Regardless of the distributive specifics, the overall system typically includes a memory 232*m* for holding color-corrected image data. These data may be developed in the computer or raster image processor, for example with specific artistic input by an operator, or may be received from an external source.

Ordinarily the input data proceed from image memory 232*m* to an image-processing stage 332 that includes some form of program memory 333—whether card memory or hard drive and RAM, or ROM or EPROM, or ASIC structures. The memory 333 provides instructions 334, 336 for automatic operation of rendition 335 and printmasking 337.

Image data cascades through these latter two stages 335, 337 in turn, resulting in new data 338 specifying the colorants to be deposited in each pixel, in each pass of the printhead carriage 20 over the printing medium 41. It remains for these data to be interpreted to form:

actual printhead-actuating signals 53 (for causing precisely timed and precisely energized ink ejection or other colorant deposition 54), actual carriage-drive signals 57 (for operating a carriage-drive motor 35 that produces properly timed motion 55 of the printhead carriage across the printing medium), and actual print-medium-advance signals 46 (for energizing a medium-advance motor 42 that similarly produces suitably timed motion of the print-medium platen 43 and thereby the medium 41).

Such interpretation is performed in the printing control module 40. In addition the printing control module 40 may typically be assigned the tasks of receiving and intepreting the encoder signal 52 fed back from the encoder sensor 233.

The printing-control stage 40 necessarily contains electronics and program instructions for interpreting the colorant-per-pixel-per-pass information 338. Most of this electronics and programming is conventional, and represented in the drawing merely as a block 81 for driving the carriage and pen. That block in fact may be regarded as providing essentially all of the conventional operations of the printing control stage 40.

4. Method

Figure 14:
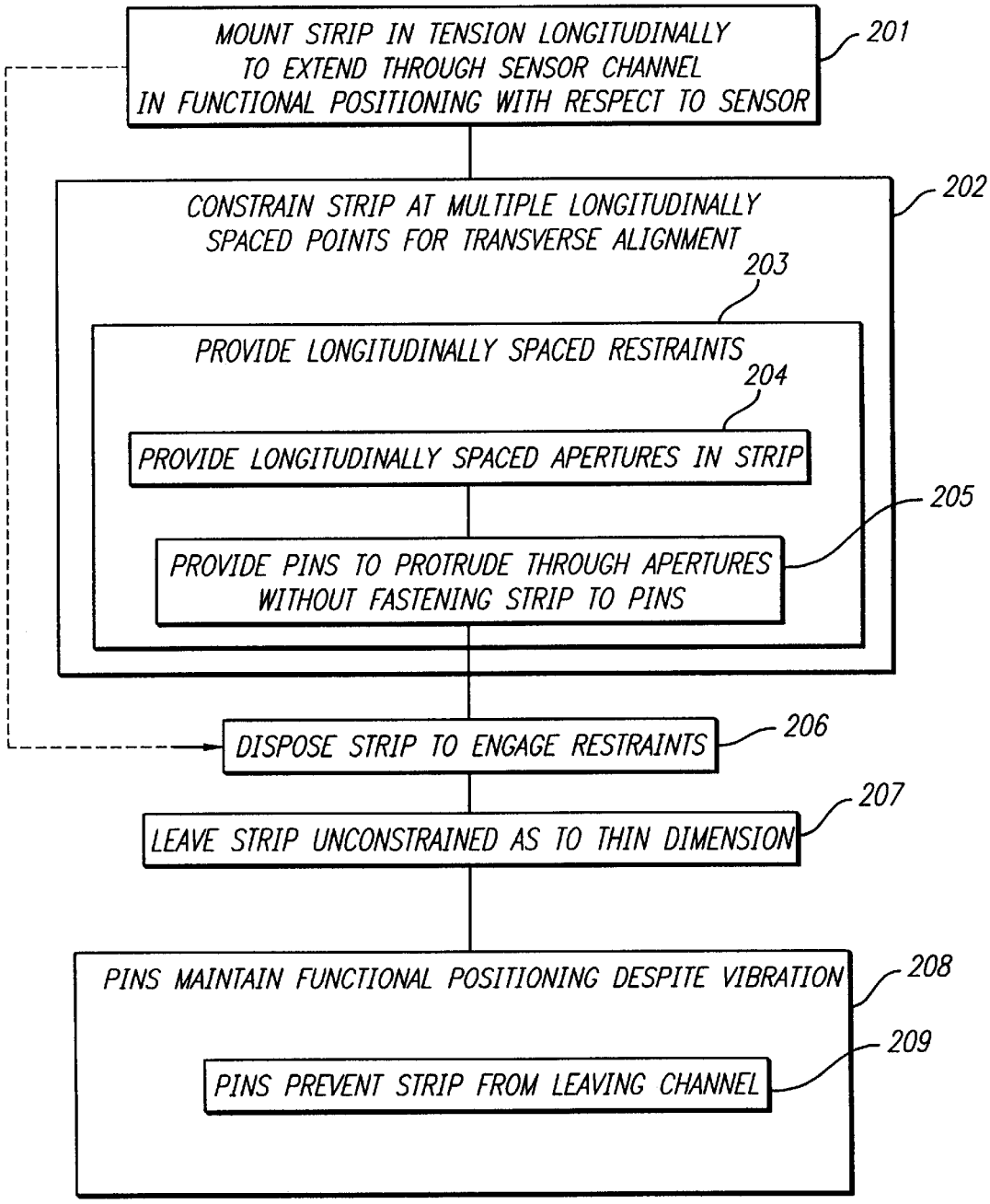
FIG. 14 is a flow chart representing a preferred form of method aspects of the invention.

As suggested in FIG. 14, which will be self explanatory to people skilled in this field, method aspects of the present may be conceptualized as having two main steps. One of these is functional mounting 201 of the codestrip through the sensor groove, in tension.

The other is constraint 202 of the strip at multiple longitudinally spaced points for transverse alignment—i. e., in the previous illustrations, alignment vertically. In some sense perhaps a third major step is the result, namely stable operation 208 of the encoder sensor system.

For preferred embodiments, in the first step 201 the strip is mounted in functional positioning with respect to sensor. The second step 202 includes provision 203 of longitudinally spaced restraints.

Although disposition 206 of the strip to engage those restraints could be regarded as part of the constraint-providing step 202, it is perhaps more logical—or at least equally so—to consider that disposition part of the mounting step 201. Therefore in FIG. 14 (note dashed arrow) and certain of the appended claims, disposition of the strip to engage the restraints is conceptualized as part of or associated with the mounting step 201.

The restraint provision 203 may be seen as further subdivided to include provision 204 of apertures in the strip, and provision 205 of pins to protrude through the apertures—without fastening of the strip to the pins.

Another significant preference is a step of omission, namely refraining 207 from acting to constrain the encoder strip with respect to its thin dimension. This step refers only to constraint at the locating pins, and thus is not absolute: at both its ends, the strip is constrained in that direction.

The above disclosure is intended as merely exemplary, and not to limit the scope of the invention—which is to be determined by reference to the appended claims.

What is claimed is:

1. An encoder strip for use, with mounting means that comprise a series of spaced pins for nonfastening support and alignment of the encoder strip, in incremental printing; said encoder strip comprising:

an elongated member defining incremental-printer encoder indicia; and a series of spaced apertures formed in the elongated member for nonclamping engagement with the spaced pins.

2. The codestrip of claim 1, wherein:

ends of the elongated member are for fastening to the mounting means, to secure and tension the elongated member; and at least one of the spaced apertures is spaced distinctly away from the fastening ends of the elongated member.

3. The codestrip of claim 2, wherein:

the codestrip is a composite strip comprising a transparent member secured to a strength member.

4. The codestrip of claim 3, wherein:

the spaced apertures are slot-shaped.

5. The codestrip of claim 4, wherein:

the elongated member exceeds approximately one hundred centimeters (approximately forty inches) in length.

6. The codestrip of claim 2, wherein:

the elongated member exceeds approximately one hundred twenty-five centimeters (approximately fifty inches) in length.

7. The codestrip of claim 1, wherein:

the apertures are shaped to constrain the elongated member with respect to exclusively one dimension.

8. The codestrip of claim 7, wherein:

the elongated member exceeds approximately one hundred centimeters (approximately forty inches) in length.

9. The codestrip of claim 8, wherein:

the elongated member exceeds approximately one hundred twenty-five centimeters (approximately fifty inches) length.

10. The codestrip of claim 8, wherein:

the spaced apertures are spaced to facilitate cutting elongated members in several different sizes from common, preapertured stock.

11. The codestrip of claim 8, wherein:

the apertures are spaced at approximately thirty centimeters (11.8 inches) on centers to facilitate cutting spans of approximately 91½, 106½, 152½ and 183 centimeters (thirty-six, forty-two, sixty and seventy-two inches) from common, preapertured stock.

12. The codestrip of claim 1, wherein:

at least one of the spaced apertures is positioned to prevent fundamental oscillation of the elongated member, due to environmental vibration, from moving the elongated member out of a specified operating position.

13. A printer, having an encoding system, for use in incremental printing and comprising:

an elongated encoder strip defining encoder indicia and having spaced apertures formed in the encoder strip;

means for mounting the encoder strip, said mounting means comprising means for nonclamping protrusion through the spaced apertures of the encoder strip to support and align the encoder strip;

said nonclamping protrusion means comprising a series of spaced pins; and means for responding to the encoder indicia to control printing.

14. The printer of claim 13, wherein:

the mounting means further comprise means for supporting ends of the encoder strip and tensioning the encoder strip;

at least one of the spaced pins is spaced distinctly away from the end-supporting means.

15. The printer of claim 14, particularly for use with a scanning printhead carriage that moves substantially parallel to the encoder strip; and further comprising:

a sensor disposed adjacent to the encoder strip and carried on the scanning printhead carriage; and wherein the responding means comprise means, responsive to the sensor, for developing signals representative of position and velocity of the sensor and carriage relative to the encoder strip.

16. The printer of claim 15, for use with a printing medium and further comprising:

printheads carried on the carriage and forming colorant patterns on the printing medium to construct an image on the medium; and a printing-medium advance mechanism providing relative motion, perpendicular to the scanning printhead carriage, between the carriage and the printing medium; and wherein the responding means further comprise a digital processor responsive to the position- and velocity-representative signals, and coordinating the printheads and the advance mechanism in forming the image.

17. The printer of claim 16, further comprising:

a floor-standing base and case for supporting and housing all of the foregoing elements.

18. The printer of claim 13, further comprising:

a dimension stack between the encoder indicia and the responding means; and wherein the dimension stack is substantially independent of encoder-strip length.

19. A method for preparing and using an encoder strip, for use in incremental printing; said strip comprising a thin, narrow, elongated member; and said method comprising the steps of:

mounting the strip in tension with respect to its elongated dimension;

constraining the strip at multiple points spaced apart along its elongated dimension, for alignment with respect to its narrow dimension; and leaving the strip substantially unconstrained, except at its ends, with respect to its thin dimension.

20. The method of claim 19, wherein:

the constraining step comprises providing spaced-apart restraints for the strip, along the elongated dimension; and the mounting step comprises disposing the strip to engage the spaced-apart restraints.

21. The method of claim 20, wherein the constraining step comprises:

providing apertures in the strip, spaced apart along the elongated dimension; and providing pins to protrude through the apertures without fastening the strip to the pins.

22. The method of claim 21, particularly for use with an encoder sensor that undergoes relative motion, with respect to the strip, along the elongated dimension; and wherein:

the mounting step comprises disposing the strip in a functional positioning with respect to the sensor;

in operation the strip is subject to vibration that tends to disturb said functional positioning; and the pins maintain said functional positioning.

23. The method of claim 22, particularly for use with an encoder sensor that has a channel for the strip; and wherein:

the mounting step comprises disposing the strip to extend through the channel in the sensor; and the pins prevent the strip from leaving the channel.

* * * * *